US007033227B2

(12) United States Patent
Karir

(10) Patent No.: US 7,033,227 B2
(45) Date of Patent: Apr. 25, 2006

(54) MODULAR JACK RECEPTACLE

(75) Inventor: Arvind Karir, Toronto (CA)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 10/855,383

(22) Filed: May 28, 2004

(65) Prior Publication Data

US 2005/0266732 A1 Dec. 1, 2005

(51) Int. Cl.
*H01R 24/00* (2006.01)

(52) U.S. Cl. ..... 439/676; 439/680

(58) Field of Classification Search ..... 439/295, 439/374, 660, 676 I, 677
See application file for complete search history.

(56) References Cited

U.S. PATENT DOCUMENTS

| | | | | |
|---|---|---|---|---|
| 4,781,626 | A | 11/1988 | Lazarshilk | |
| 4,813,892 | A | 3/1989 | Strate | |
| 5,387,135 | A | 2/1995 | Shen et al. | |
| 5,876,219 | A | 3/1999 | Taylor et al. | |
| 5,890,932 | A * | 4/1999 | Muta | 439/682 |
| 5,951,330 | A | 9/1999 | Reichard, Jr. et al. | |
| 5,984,731 | A | 11/1999 | Laity | |
| 6,074,256 | A | 6/2000 | Arnett | |
| 6,168,473 | B1 | 1/2001 | Hsin | |
| 6,190,195 | B1 * | 2/2001 | Yamamoto et al. | 439/381 |
| 6,257,935 | B1 | 7/2001 | Zhang et al. | |
| 6,283,796 | B1 | 9/2001 | Yeh | |
| 6,296,528 | B1 | 10/2001 | Roberts et al. | |
| 6,767,257 | B1 * | 7/2004 | Arnett et al. | 439/676 |
| 6,814,624 | B1 * | 11/2004 | Clark et al. | 439/676 |

* cited by examiner

*Primary Examiner*—Thanh-Tam Le
(74) *Attorney, Agent, or Firm*—Blank Rome LLP

(57) ABSTRACT

The present invention is related to an adapter or connector receptacle intended to mate with a plug. The receptacle includes a housing forming a passage for accepting a plug body therein during an insertion of the plug into the passage. An interference projection is mounted in and extends into the passage, the projection having a front side facing approximately perpendicular to the longitudinal axis of the plug. When during insertion of the plug into the passage, if one of the plug electrical contacts is misaligned such that its distal end is too low, the electrical contact will impact the front side of the interference projection and be deflected upward or prevent the plug from being inserted into the receptacle to avoid damaging the receptacle contacts.

12 Claims, 2 Drawing Sheets

MODULAR JACK RECEPTACLE

BACKGROUND OF THE INVENTION

1. Field of the Invention

The present invention relates generally to electrical connectors. More particularly, the present invention relates to an RJ-type electrical receptacle having interference projections for preventing complete insertion of electrical plugs with misaligned contacts.

2. Description of the Prior Art

Modular jack plugs are well known in the art for use in terminating electrical cables containing multiple insulated conductor wires. The manufacturing process used to terminate those cables involves using a plurality of contact tines seated inside the jack plug that cut through the insulation on the conductor wires in the cable thereby making electrical contact with those conductors. Historically, that manufacturing processes posed quality control problems resulting in the misplacement of the plug contacts. For example, if, during manufacturing, the conductors in the cables were not completely connected to the plug contacts (or vice versa), or the contacts were not completely situated in the plug housing slots, the plug contacts would be misaligned relative to the plug housing or become misaligned with use.

A jack plug with one or more misaligned contacts can damage a corresponding receptacle as it is being mated with that receptacle. For example, if a misaligned contact on the plug is lower than it should be, the leading edge, or tip, of the misaligned contact will impact the corresponding mating receptacle contact and cause it to be deformed. Once deformed, the receptacle contact will thereafter be misaligned. Then, upon the insertion and mating of a different plug having properly aligned plug contacts, the mating of the plug and the receptacle may not provide the required electrical contact, thereby becoming unreliable and failing to meet specifications.

A general solution for preventing the insertion of a plug of one type of equipment in a receptacle of another type of equipment has been to implement industry standard sizes for various interconnect applications. The International Organization for Standardization (ISO) 31.220.10, for example, provides standardization for electromechanical components related to electronic and telecommunications equipment, specifically plug-and-socket devices. Thus, for example, an RJ-type receptacle for telephony applications is not designed to accommodate a BNC cable termination plug used in video and data transmission applications because the BNC plug and RJ receptacle have different shapes and sizes. Similarly, an RJ-11-type receptacle is not designed to accommodate an RJ-45-type termination plug because the RJ-45 plug is too large to fit inside the insertion passage of an RJ-11 receptacle.

Another solution for preventing the insertion of a plug into the wrong receptacle is to provide labels or the use of colored materials on the interconnecting parts. For example, a receptacle labeled with "RJ-45" and a plug labeled with "RJ-11" could inform the user of the incompatibility of the two devices. Or, the RJ-45 receptacle could be made out of a black plastic material that is a different color than the plug to inform the user of the incompatibility.

Another solution for preventing the insertion of a plug into the wrong receptacle is to use an interference stop. For example, since an RJ-11 plug is smaller than the opening of an RJ-45 plug and, thus, could be inserted into an RJ-45 plug, an interference stop that is integral to the RJ-45 receptacle can be used to prevent such an insertion.

Interference stops are disclosed in U.S. Pat. No. 6,375,516 to Trinh. In that patent, FIG. 5 illustrates interference stops protruding into the insertion passage of a receptacle from the bottom of the molded plastic housing. The stops, which are disclosed as being 0.024 inches in length, 0.20 inches wide and 0.017 inches high, are positioned to block full insertion of an RJ-11 plug into an RJ-45 receptacle. In U.S. Pat. No. 6,186,835 to Cheshire, a flexible barrier stop is provided that, as shown in FIG. 3, displaces out of the insertion cavity of the receptacle and allows an RJ-45 plug to be fully inserted but does not displace completely if a small RJ-11 plug is inserted. U.S. Pat. No. 6,257,935 to Zhang et al. discloses the use of two spring members positioned within an RJ-45 receptacle for preventing the insertion of an RJ-11 plug.

Thus, the solution to preventing insertion of the wrong size or wrong type of plug into a receptacle has been to use industry standard plug and connector sizes and configurations, prominent labels, different colored materials, and/or interference stops, among other methods. None of those solutions, however, are suitable solutions to the aforementioned problem of preventing mating of corresponding plugs and receptacles where the plugs have misaligned contacts.

SUMMARY OF THE INVENTION

In view of the foregoing, it should be apparent that there still exits a need in the art for a method and apparatus for preventing the insertion of a terminating plug into a corresponding mating receptacle if the plug has one or more misaligned contacts.

It is an object of the invention, therefore, to provide a receptacle having one or more interference projections extending into the insertion pathway of the receptacle for mechanically aligning a misaligned plug contact, if the misalignment is not severe, or for preventing insertion of the plug altogether, and, consequently, damage to the receptacle contacts, if the misalignment is severe.

More particularly, it is an object of the invention to provide an RJ-type receptacle having a plurality of sloped interference projections extending up and back from approximately the leading edge of the opening of the insertion pathway of the receptacle.

Still more particularly, it is an object of the invention to provide an RJ-11 or RJ-45 receptacle with six or eight interference projections, respectively, positioned in front of the receptacle contacts.

Another object of the invention is to provide a plurality of interference projections having a front side with a width that is approximately the same as the width of the receptacle contacts and is sloped rearward, in the longitudinal or plug insertion direction measured from a forward leading bottom edge of the front side to the top edge of the front side, at a sufficient angle to deflect upward a misaligned plug contact or prevent further insertion of the plug.

A further object of the present invention is to provide a plurality of interference projections having a front side with a width that is approximately the same as the width of the receptacle contacts and a height that is sufficiently high to deflect the tip of a misaligned plug contact upward so the tip impacts the receptacle contact at a pre-determined position.

Briefly described, these and other objects of the invention are accomplished in accordance with its apparatus aspects by providing a receptacle intended to mate with a plug, the plug having a body with a longitudinal axis and plug electrical contacts arranged in a row approximately transversely to the longitudinal axis, the distal ends of which are at a pre-set distance from the bottom of the plug body, and spacers between each of the plug electrical contacts. The receptacle itself includes a housing forming a passage for accepting the plug body therein during insertion of the plug in a substantially longitudinal direction into the passage and an interference projection mounted in and extending into the passage having a front side facing approximately perpendicular to the longitudinal axis of the plug, wherein the height of the front face is D. During insertion of the plug into the passage, if one of the plug electrical contacts has a distal end positioned such that its height above the bottom of the plug body is less than D the contact will impact the front side of the interference projection.

The receptacle may also include receptacle electrical contacts arranged in a row transversely to the longitudinal direction of the passage. The interference projection is mounted in the passage and is between an opening in the passage and one of the receptacle electrical contacts.

During insertion of the plug into the passage the first interference projection is located in a pathway between one of the plug electrical contacts and one of the receptacle electrical contacts. Also during insertion of the plug into the passage, if one of the plug electrical contacts has a distal end positioned such that its height above the bottom of the plug body is less than D the contact will impact the front side of the interference projection and be deflected upward or prevent the plug from mating with the receptacle.

The objects of the invention are also accomplished where the receptacle is either an RJ-45 or an RJ-11 receptacle. The interference projection has a front side with a width that is less than the width of each of the plurality of plug spacers.

With these and other objects, advantages and features of the invention that may become hereinafter apparent, the nature of the invention may be more clearly understood by reference to the following detailed description of the invention, the appended claims and to the several drawings attached herein.

DETAILED DESCRIPTION OF THE INVENTION

Figure 1:
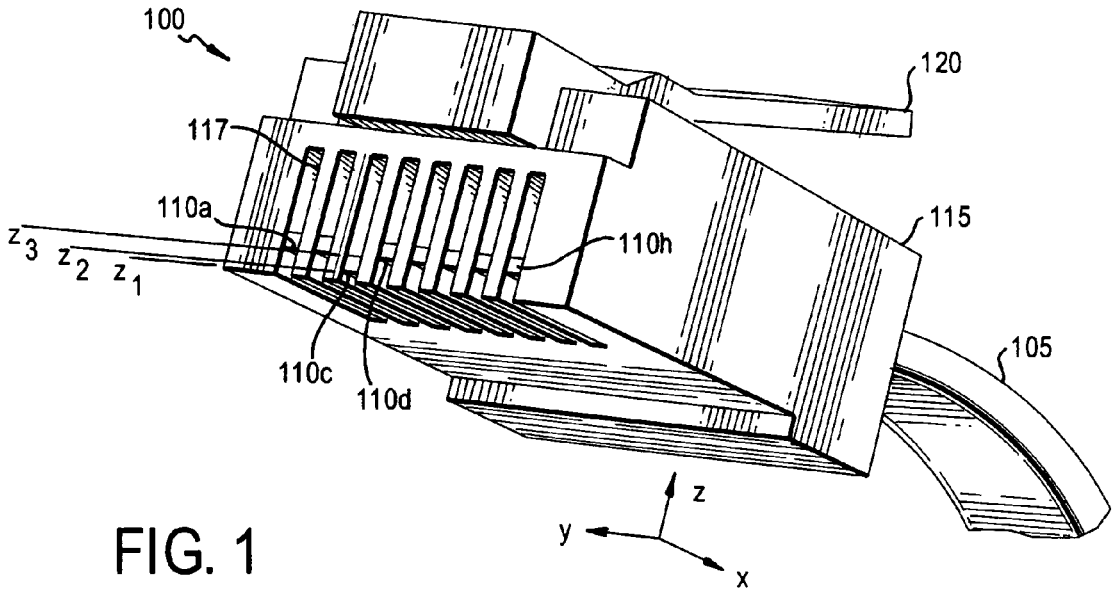
FIG. 1 is a partial perspective view of an RJ-type cable termination plug having a misaligned contact.

Referring now in detail to the drawings, wherein like parts are designated by like reference numerals throughout, there is illustrated in FIG. 1 a partial perspective view of an RJ-45 plug 100 that terminates an electrical cable 105. The RJ-45 plug is used here for illustration purposes only, and is generally well known in the art. That is, but for the fact that the RJ-45 plug 100 shown in FIG. 1 has a misaligned contact (as described below), the RJ-45 plug 100 is prior art and forms no part of the present invention. One of ordinary skill in the art will understand and recognize that the present invention could also be made and used in connection with an RJ-11 plug or in connection with non-standard and custom made RJ-type plugs.

The cable 105 contains multiple insulated electrical conductors (not shown). In the case of the RJ-45 plug 100, the cable 105 will have at least eight separate insulated conductors. In the case of an RJ-11 plug, the cable 105 should have at least six separate insulated conductors.

Referring now to the RJ-45 plug 100 of FIG. 1, each of the at least eight conductors of the cable 105 will be electrically coupled to one of the eight separate contact tines 110*a*–110*h* using standard termination techniques common in the industry. The plug contacts 110*a*–110*h* are maintained inside an RJ-45 plug housing 115, which housing meets industry standard specifications for size and shape (among other specifications). Housings that do not meet industry specifications are also contemplated, such as proprietary and custom-made housings.

The plug housing 115 is used to seat n plug contacts. In FIG. 1, there are eight plug contacts 110*a*–110*h* shown (i.e., n=8) seated in a pre-set position relative to the plug housing 115. That pre-set position is determined in accordance with the industry standard specification or, in the case of a custom-made plug, by a customer specification. A series of spacer walls 117, arranged transversely (i.e., in the y-axis direction), maintain the transverse separation distance between the plug contacts 110*a*–110*h*.

The plug housing 115 may also include a flexible, cantilevered, latch bar 120 for removing the plug 100 from a receptacle after mating.

In FIG. 1, the bottom front edge of the housing 115 defines a z-plane: $Z_1$. The bottom front edges of the plug contacts 110*c*–110*h* should be approximately aligned with a plane $Z_3$ that is substantially parallel with $Z_1$. The vertical separation distance between $Z_1$ and $Z_3$ is d, so that for each plug contact the vertical separation distance between the bottom front edge of the plug contact and the plane $Z_1$ is $d_i$, where i=0, 1, 2, . . . n. In FIG. 1, however, the contact 110*c*, which in this case is the third contact from the left, is in a misaligned position such that the bottom front edge of the contact 110*c* (i.e., the tip of the contact) is aligned with a plane $Z_2$, which is somewhere between the $Z_1$ and $Z_3$ planes. In other words, the plug contact 110*c* is lower than where is should be relative to the other plug contacts. That misalignment can be caused during manufacturing of the plug 100. For example, the contact 110*c* may not be properly electrically coupled to the corresponding conductor in the cable 105, it may have been bent during manufacturing, or it may be misaligned due to some other quality control problem.

Figure 2:
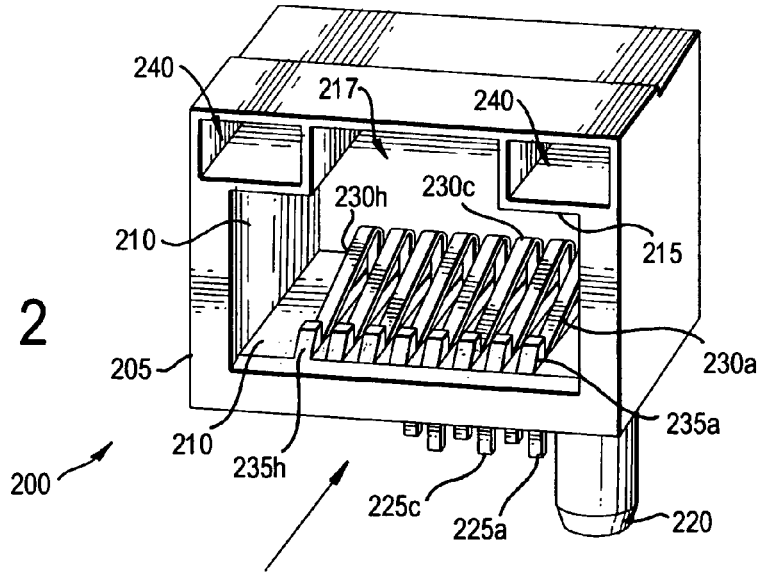
FIG. 2 is a partial perspective view of an RJ-type receptacle having a plurality of interference projections according to the present invention.

FIG. 2 is a partial perspective view of an RJ-45 receptacle 200. The receptacle 200 includes a receptacle housing 205. The receptacle housing 205 has top, bottom, left and right interior walls 210 that form a substantially rectangular opening 215, which is approximately the shape of the corresponding RJ-45 plug housing 115 shown in FIG. 1. Behind the opening 215 is a cavity 217 that accepts the plug 100. The plug 100 may be inserted through the opening 215 in the direction of the arrow (i.e., the insertion pathway). When fully inserted into the cavity 217, the plug 100 will be electrically mated with the connector 200.

Tabs (not shown) may extend from the sides and/or top of the exterior of the receptacle housing 205 to secure the receptacle 200 to a substrate. The receptacle housing 205 may be made from a plastic and/or metal material; portions of the receptacle housing 205 may also be made from an EMI-shielding material or the housing may be encased in an EMI shield. A pair of LEDs may be optionally inserted into the LED cavities 240.

If the receptacle 200 is used in connection with a printed circuit board, there will be included, exteriorly of the receptacle housing 205 as shown in FIG. 2, one or more mounting posts 220 (only one shown) and eight data pins 225*a*–225*h* (only six shown). Only six data pins will be required in the case of an RJ-11 plug. The posts 220 and data pins 225*a*–225*h* are inserted into respective sockets on a printed circuit board to complete an electrical circuit between the cable 105 and the printed circuit board.

The data pins 225*a*–225*h* correspond to the individual receptacle electrical contacts 230*a*–230*h* shown projecting upward, at an angle, into the receptacle cavity 217. Thus, when the plug 100 is inserted into the receptacle 200, the plug contacts 110*c*–110*h* will make contact with the receptacle contacts 230*a*–230*h* at a pre-determined location on the sloped portion of the receptacle contacts 230*a*–230*h*. That pre-determined position is selected to satisfy specifications of the connector 200.

FIG. 2 also shows a plurality of interference projections 235*a*–235*h*, according to the present invention. The interference projections 235*a*–235*h* are located between the forward or leading edge of the receptacle contacts 230*a*–230*h* and the front edge of the receptacle cavity 217 near the opening 215. Each of the interference projections 235*a*–235*h* is approximately the same width as the receptacle contacts 230*a*–230*h*, but narrower than the widths of two adjacent, oppositely facing walls 117 (as seen in FIG. 1). In FIG. 2, the interference projections 235*a*–235*h* are located directly in front of the receptacle contacts 230*a*–230*h*. The distance separating one interference projection 235*a*–235*h* from the next interference projection 235*a*–235*h* should be sufficient to allow the walls 117 of the plug 100 to slide between the interference projections 235*a*–235*h* without minimal interference.

Not every receptacle contact 230*a*–230*h* requires an interference projection 235*a*–235*h*. For example, it may not be necessary to have an interference projection positioned in front of a receptacle contact that would be used to operate an LED located in one of the LED cavities 240 if, for example, the application does not require the use of an LED for communicating the status of the interconnection of the plug 100 and the connector 200.

Figure 3:
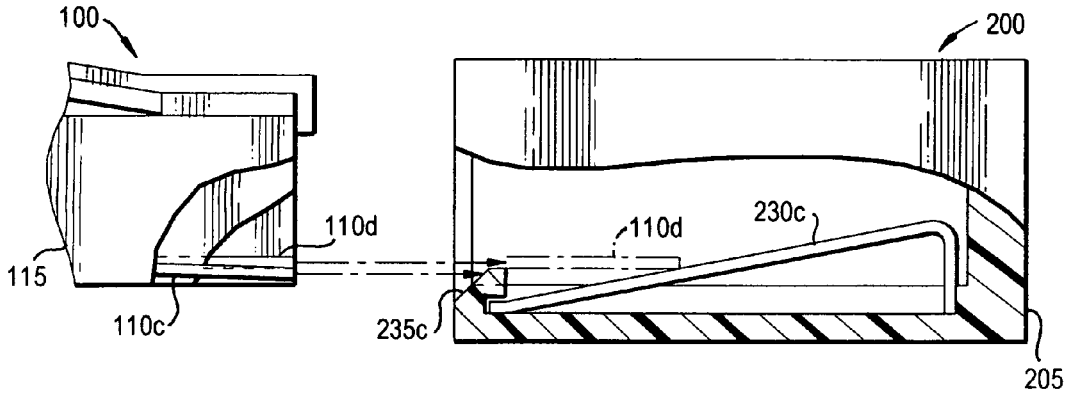
FIG. 3 is a partial cross-sectional elevation view of the RJ-type plug of FIG. 1 being inserted into the RJ-type receptacle of FIG. 3.

FIG. 3 is a partial cross-sectional elevation view of the RJ-45 plug 100 of FIG. 1 before being inserted into the RJ-45 receptacle 200 of FIG. 2 and as a portion of it is being inserted into the receptacle 200. The partial cross-sectional view of the plug 100 shows the plug contact 110*c* improperly seated in the plug 100 such that it is misaligned (i.e., angled slightly downward). The partial cross-sectional view of the plug 100 also shows the plug contact 110*d*, which is immediately behind (next to) the plug contact 110*c*. The plug contact 110*d* is shown in a properly aligned position roughly parallel to the insertion pathway of the plug 100 as indicated by the top arrow. In the partial cross-sectional view of the RJ-45 receptacle 200, the plug contact 110*d* is shown in its second position, as indicated by the broken line, just as it initially touches the receptacle contact 230*d* (not shown) at a pre-determined location, thereby establishing an electrical contact between the plug contact 110*d* and the receptacle contact 230*d*.

FIG. 3 also shows the cross-section view of the interference projection 235*c* and illustrates how the plug 100, with the misaligned plug contact 110*c*, is inserted into the receptacle 200. The plug contact 110*c* makes initial contact with the sloped front side of the interference projection 235*c* in the direction as indicated by the bottom arrow. If the leading edge, or tip, of the plug contact 110*c* is severely misaligned (i.e., angled down too far), the front side of the interference projection 235*c* will interfere with or impede the movement of the plug 100 in the direction of the insertion pathway and prevent the plug 100 from being fully inserted into the receptacle 200 and damaging the receptacle contact 230*c*. If, however, the leading edge, or tip, of the plug contact 110*c* is not severely misaligned, the front side of the interference projection 235*c* will deflect the leading edge, or tip, of the plug contact 110*c* upward and allow the plug 100 to be fully inserted into the receptacle opening 215 and mate with the receptacle 200 at the appropriate pre-determined location on the receptacle contact 230*c*.

Figure 4:
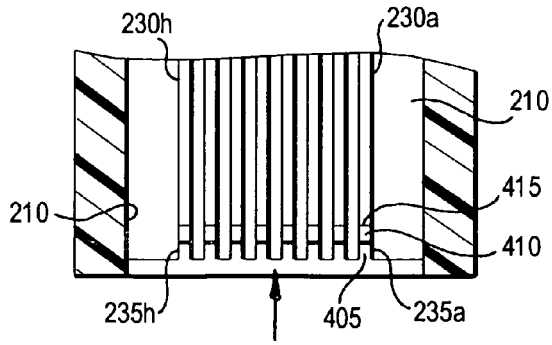
FIG. 4 is a partial cross-sectional plan view of the RJ-type receptacle of FIG. 3 showing the alignment of interference projections according to the present invention.

FIG. 4 is a partial cross-sectional plan view of the RJ-45 receptacle of FIG. 3 showing the alignment of the interference projections 235*a*–235*h* with the receptacle contacts 230*a*–230*h*. The interference projections 235*a*–235*h* have a front side 405 and a top side 410. In the preferred embodiment, the height of each of the interference projection 235*a*–235*h* is about 0.022 inches and the depth in the longitudinal direction (i.e., the insertion direction) is about 0.020 inches. The front side 405 of each interference projection 235*a*–235*h* is preferably angled between 45 and 90 degrees relative to the bottom wall 210 (as best seen in FIG. 3). The interference projections 235*a*–235*h* are preferably made of the same material as the connector housing 205.

Other embodiments of the interference projections are also contemplated as being within the nature and scope of the invention. For example, the slope or angle of the front side 405 of the interference projections 235*a*–235*h* may be greater or smaller than the preferred slope/angle. The front side 405 also does not have to be flat, but instead could have a notch or a cut-out or other structure on the surface. It could also be arcuate rather than flat. The front face 405 may be tapered and narrowed in the direction toward the receptacle opening 215 to provide for spacer walls 117 that may not be perfectly aligned and also to facilitate alignment of the spacer walls 117 between the interference projections 235*a*–235*h*. The front face 405 could also have portions that are angled other than approximately perpendicular to the longitudinal direction of the insertion pathway. Moreover, the overall length of the top side 410 could be increased so that the back side 415 is closer to the corresponding receptacle contact 230*a*–230*h*.

Although certain presently preferred embodiments of the present invention have been specifically described and shown herein, it will be apparent to those skilled in the art to which the invention pertains that many variations and modifications of the various embodiments shown and described herein may be made in light of the above teachings without departing from the spirit and scope of the invention. Accordingly, it is intended that the invention be limited only to the extent required by the appended claims and the applicable rules of law.

What is claimed is:

1. A receptacle intended to mate with a plug, the plug having a body with a longitudinal axis and a plurality of plug electrical contacts, n, arranged in a row approximately transversely to the longitudinal axis, distal ends of the plug electrical contacts are at a distance $d_i$, $d_{i+1}$, . . . $d_n$, respectively, from a bottom of the plug body, and a plurality of spacers between each of the plurality of plug electrical contacts, the receptacle comprising:

a housing forming a passage for accepting the plug body therein during an insertion of the plug in a substantially longitudinal direction into the passage;

a first interference projection mounted in and extending into the passage, wherein a height of the first interference projection is D, a plurality of receptacle electrical contacts arranged in a row transversely to the longitudinal direction of the passage;

wherein during insertion of the plug into the passage, the first interference projection is located in a pathway between the one of the plurality of plug electrical contacts and one of the plurality of receptacle electrical contacts, and wherein during insertion of the plug into the passage, one of the plurality of plug electrical contacts having a distal end positioned such that a height of the distal end is above the bottom of the plug body is less than D the distal end impacts the first interference projection, the first interference projection deflecting upwardly the distal end of the one of the plurality of plug electrical contacts.

2. The receptacle according to claim 1, wherein the first interference projection is mounted in the passage and is between an opening in the passage and one of the plurality of receptacle electrical contacts.

3. The receptacle according to claim 1, where the first interference projection has a sloped front side.

4. The receptacle according to claim 1, wherein during insertion of the plug into the passage, the one of the plurality of plug electrical contacts impacts the front side of the first interference projection, thereby preventing the plug from mating with the receptacle.

5. The receptacle according to claim 1, wherein the receptacle is either an RJ-45 or an RJ-11 receptacle.

6. The receptacle according to claim 1, wherein the first interference projection has a front side with a width that is less than a width of each of the plurality of plug spacers.

7. The receptacle according to claim 1, ffirther comprising a second interference projection mounted in the passage next to the first interference projection, wherein the second interference projection includes a front side facing approximately perpendicular to the longitudinal axis of the plug and wherein the height of the front side is D.

8. A receptacle intended to mate with a plug, the plug having a body with a longitudinal axis and a plurality of plug electrical contacts, n, arranged in a row approximately transversely to the longitudinal axis, distal ends of the plug electrical contacts are at a distance $d_i$, $d_{i+1}$, . . . $d_n$, respectively, from a bottom of the plug body, and a plurality of spacers between each of the plurality of plug electrical contacts, the receptacle comprising:

a housing forming a passage for accepting the plug body therein during an insertion of the plug in a substantially longitudinal direction into the passage;

a plurality of interference projections mounted in and extending into the passage, wherein each of the plurality of interference projections includes front side forming an angled ramp surface and wherein a height of the front faces is D, a plurality of receptacle electrical contacts arranged in a row transversely to the longitudinal direction of the passage;

wherein during insertion of the plug into the passage, the plurality of interference projections are located in a pathway between the one of the plurality of plug electrical contacts and one of the plurality of receptacle electrical contacts, and wherein during insertion of the plug into the passage, one of the plurality of plug electrical contacts having a distal end positioned such that a height of the distal end is above the bottom of the plug body is less than D the distal end impacts the front side of at least one of the plurality of interference projections, the at least one of the plurality of interference projections deflecting upwardly the distal end of the one of the plurality of plug electrical contacts.

9. The receptacle according to claim 8, wherein the plurality of interference projections are mounted in the passage and are between an opening in the passage and the plurality of receptacle electrical contacts.

10. The receptacle according to claim 8, wherein during insertion of the plug into the passage, the one of the plurality of plug electrical contacts impacts the front side of the one of the plurality of interference projections, thereby preventing the plug from mating with the receptacle.

11. The receptacle according to claim 8, wherein the receptacle is either an RJ-45 or an RJ-11 receptacle.

12. The receptacle according to claim 8, wherein the plurality of interference projections each have a front side with a width that is less than a width of each of the plurality of plug spacers.

* * * * *